US007204031B2

(12) United States Patent
Hanson

(10) Patent No.: US 7,204,031 B2
(45) Date of Patent: Apr. 17, 2007

(54) TELESCOPING T-SQUARE

(76) Inventor: Craig A. Hanson, 40 Colonial Dr., Andover, MA (US) 01810

( * ) Notice: Subject to any disclaimer, the term of this patent is extended or adjusted under 35 U.S.C. 154(b) by 0 days.

(21) Appl. No.: 11/186,781

(22) Filed: Jul. 22, 2005

(65) Prior Publication Data

US 2007/0017108 A1 Jan. 25, 2007

(51) Int. Cl.
*B43L 7/02* (2006.01)
*B43L 7/10* (2006.01)

(52) U.S. Cl. ..... 33/479; 33/468; 33/478; 33/809; 403/64

(58) Field of Classification Search ..... 33/418, 33/419, 427, 452, 464, 465, 768, 469, 470, 33/472, 473, 474, 478, 479, 495, 500, 809; 403/13, 14, 59, 61, 109.3, 65
See application file for complete search history.

(56) References Cited

U.S. PATENT DOCUMENTS

| | | | | | |
|---|---|---|---|---|---|
| 798,721 | A * | 9/1905 | Wilson | 33/468 |
| 914,635 | A | 3/1909 | Bryant et al. | 403/156 |
| 1,268,711 | A | 6/1918 | Griffits | 33/469 |
| 2,078,601 | A * | 4/1937 | Cutting | 33/468 |
| 2,238,581 | A * | 4/1941 | De Lisle | 33/468 |
| 2,265,695 | A * | 12/1941 | Lee | 33/468 |
| 2,622,330 | A * | 12/1952 | Neiman | 33/469 |
| 2,724,184 | A * | 11/1955 | Spear, Jr. | 33/479 |
| 3,526,040 | A * | 9/1970 | Young | 33/809 |
| 4,047,821 | A * | 9/1977 | Hoke et al. | 403/109.3 |
| 4,525,933 | A | 7/1985 | Patterson | 33/470 |
| 4,920,658 | A | 5/1990 | Hile | 33/499 |
| 5,367,783 | A * | 11/1994 | Nygren | 33/613 |
| 5,832,618 | A * | 11/1998 | Scarborough | 33/451 |
| 5,839,201 | A | 11/1998 | Young | 33/451 |
| 6,134,797 | A * | 10/2000 | Boyce | 33/464 |
| 7,073,267 | B2 * | 7/2006 | Butler et al. | 33/203 |
| 7,082,692 | B2 * | 8/2006 | Shapiro | 33/473 |

* cited by examiner

*Primary Examiner*—R. Alexander Smith
(74) *Attorney, Agent, or Firm*—Richard C. Litman

(57) ABSTRACT

The telescoping T-square has a crossbar or cross-member and an extendable shaft or leg. The cross-member is a relatively short bar having a pair of parallel runners longitudinally extending across the length of one surface of the bar and a slot defined through the bar between the runners that extends from the center of the bar laterally towards one of the ends of the bar. The leg has a tubular, hollow proximal rod removably attached to the cross-member, and at least one telescoping distal rod slidably disposed in the proximal rod, with detent buttons locking the rods together at selected intervals. One end of the proximal rod has transverse grooves or channels defined therein slidably receiving the runners and a threaded stud extending therefrom that is slidable in the slot defined in the cross-member. A knob engages the stud to temporarily lock the cross-member and leg in fixed relation.

12 Claims, 3 Drawing Sheets

TELESCOPING T-SQUARE

BACKGROUND OF THE INVENTION

1. Field of the Invention

The present invention relates to carpentry tools for precisely aligning two or more objects. More particularly, the invention relates to a telescoping T-square, wherein the shaft of the T-square is designed to be telescoping and can be extended to permit the accurate alignment of distant objects.

2. Description of the Related Art

The T-square is at least as ubiquitous as the drafting table or the carpenter's toolbox, yet its basic design has changed very little in years of use. The tool is without peer in laying out flooring and wall tiling paths, cutting wallboards exactly, laying out wiring or piping paths, drawing blueprints and many others uses. However, the convenience with which a T-square can define a right angle contributes in some respects to the limits placed on its use. The junction of the shaft or pole and the crossbar or cross-member of the conventional T-square is fixed, usually being manufactured to exactly and unalterably form a precise right angle and none other. The length of the shaft is short, and so the tool is limited to defining only a right angle between objects that are relatively close together. But there are many instances where the definition of a right angle must be made between two objects that are relatively distant from each other, for instance, setting the placement of footings for a deck attached to a house or for the foundation of a house.

Another drawback to the conventional T-square is its inevitably awkward shape, which doesn't fit into common toolboxes. The longer the shaft, the more awkward the T-square becomes. As a result, mechanics, machinists, and carpenters must care for the tool separately from other tools.

Thus a telescoping T-square solving the aforementioned problems is desired.

SUMMARY OF THE INVENTION

The telescoping T-square is a T-square dimensioned and configured for accurately installing footings for decks and other structures. The T-square has a crossbar or cross-member and an extendable shaft or leg. The cross-member is a relatively short bar having a pair of parallel runners longitudinally extending across the length of one surface of the bar and a slot defined through the bar between the runners that extends from the center of the bar laterally towards one of the ends of the bar. The leg has a tubular, hollow proximal rod removably attached to the cross-member, and at least one telescoping distal rod slidably disposed in the proximal rod, with detent buttons locking the rods together at selected intervals. One end of the proximal rod has transverse grooves or channels defined therein slidably receiving the runners and a threaded stud extending therefrom that is slidable in the slot defined in the cross-member. A knob engages the stud to temporarily lock the cross-member and leg in fixed relation.

Preferably the cross-member is about four feet long and the telescoping leg is composed of three rods or telescoping members that are extendable in a range of between about six and sixteen feet. The proximal rod and the telescoping intermediate rod may have apertures defined therein at one-foot intervals that receive the spring-biased detent button mounted on the succeeding distal rod for extending the telescoping leg to a precise length. The slidable engagement of the runners in the grooves or channels permits the locking knob to be loosened so that the leg can slide laterally on the cross-member while accurately and precisely maintaining a 90° angle between the cross-member and the telescoping leg. Alternatively, the knob may be loosened far enough to permit the runner to be raised out of the channels so that the leg may be rotated relative to the cross-member to any desired angle and locked in place by tightening the knob.

Both the cross-member and the telescoping rod may have a scale or graduations either imprinted thereon or engraved or stamped therein. The telescoping T-square may be made of lightweight aluminum or aluminum alloys for ease in transport and storage. Mating ends of the telescoping sections may have plastic sleeves disposed either externally or internally for maintaining the telescoping sections in proper alignment.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a telescoping T-square that has a telescoping shaft or leg that is slidably and rotatably attached to the cross-member. The telescoping T-square permits the leg to slide upon the cross-member while maintaining a 90° angle in order to site footings that are spaced apart by more than three feet. The T-square can site positions up to 90° apart by rotating the leg to a desired angular setting and at a distance of up to sixteen feet by extending the telescoping leg. After use, the telescoping T-square of the invention can be folded and collapsed within itself to a manageable length of six feet for transportation and storage.

Figure 1:
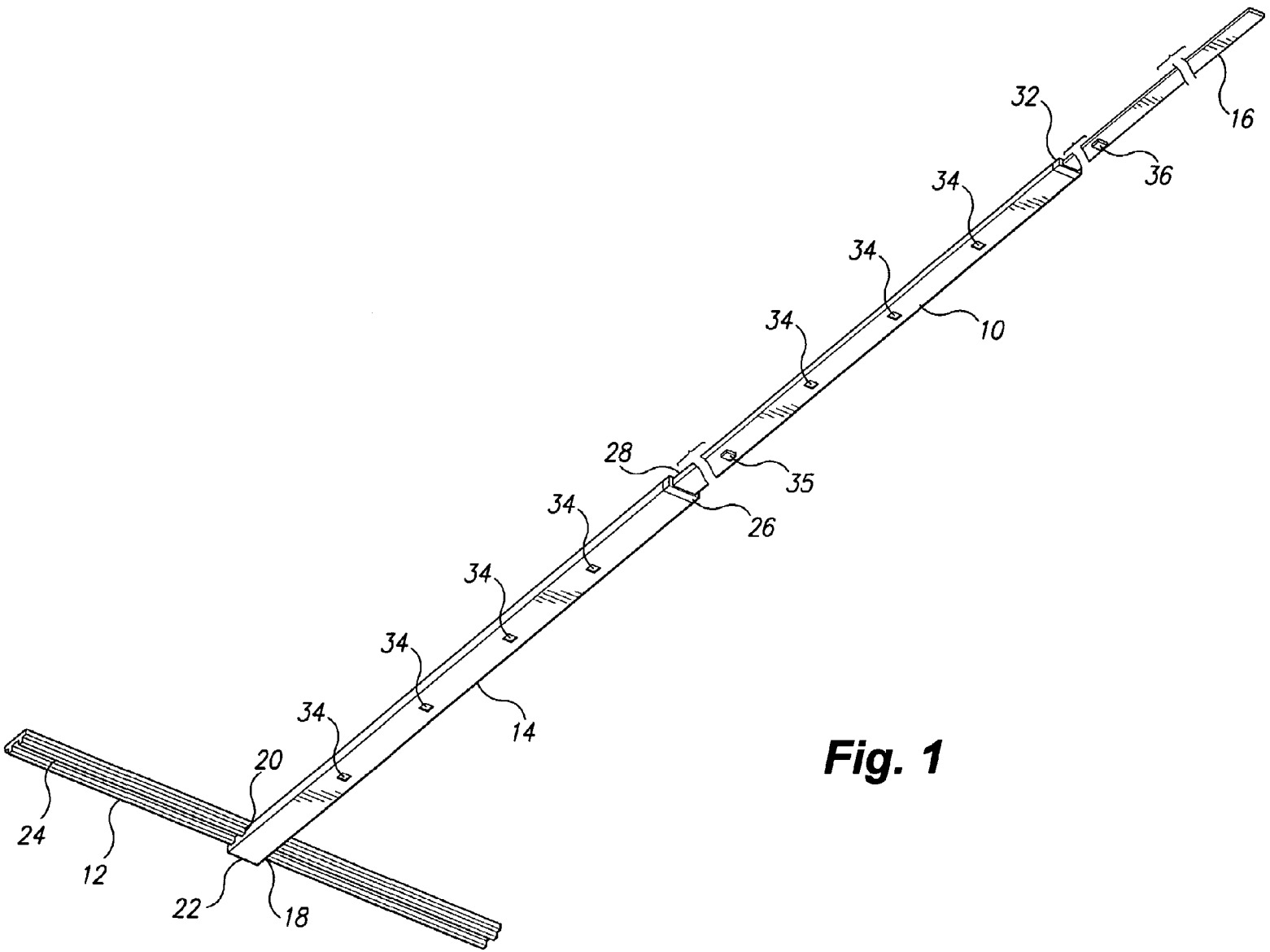
FIG. 1 is a bottom perspective view of the telescoping T-square according to the present invention.

Referring to FIG. 1, a bottom perspective view of an assembled and extended telescoping T-square is shown. The individual sections include the cross-member 12, the first or top section of the center hollow rod 14, the second or middle section of the hollow rod 10, and the third or bottom section 16. At the junction 18 of the cross-member 12 with the hollow first rod section 14, the configuration shows the parallel slots 20 in the top end 22 of the first rod section 14 mated and imbedded with the runners 24 of the cross-member 12 to form a fixed 90° structure of cross-member 12 and rod 14. The first rod 14 and the hollow second rod 10 are telescopically joined by inserting the end 28 of rod 10 through a plastic sleeve 26 retained in the open end of first rod 14. The end 28 of rod 10 may have a plastic fitting thereon that is slidable within hollow first rod 14.

The hollow second rod 10 and third rod 16 are joined by insertion of the end of rod 16 through a plastic sleeve 32 retained in the open end of rod 10. The end of third rod 16 that slides into second rod 10 may also have a plastic fitting thereon that is slidable within second rod 10. The third rod 16 may be solid, if desired, but is preferably hollow for light weight.

In the bottom surface of each of the first 14 and second sections 10, there are a plurality of detent apertures 34 or holes at spaced intervals, e.g., one foot, which form part of a spring detent system. The second section 10 of the telescoping leg has a spring-biased detent button 35 extending from the bottom surface adjacent the end inserted into the first section 14. Button 35 engages the apertures 34 in the first section to lock the first 14 and second 10 sections together at the desired length. The third section simply has a detent button 36 at the end that is inserted into the second section 10 that engages the apertures 34 in the second section for the same purpose.

The first, second, and third rod sections 14, 10, and 16 preferably have a rectangular cross section, but circular and other cross sectional structures can be used as well. All three sections, first 14, second 10, and third 16, are six feet long and when fully interconnected provide a telescopic T-square with a length of sixteen feet. When the sections are closed the length of the combined pieces is six feet.

Figure 2:
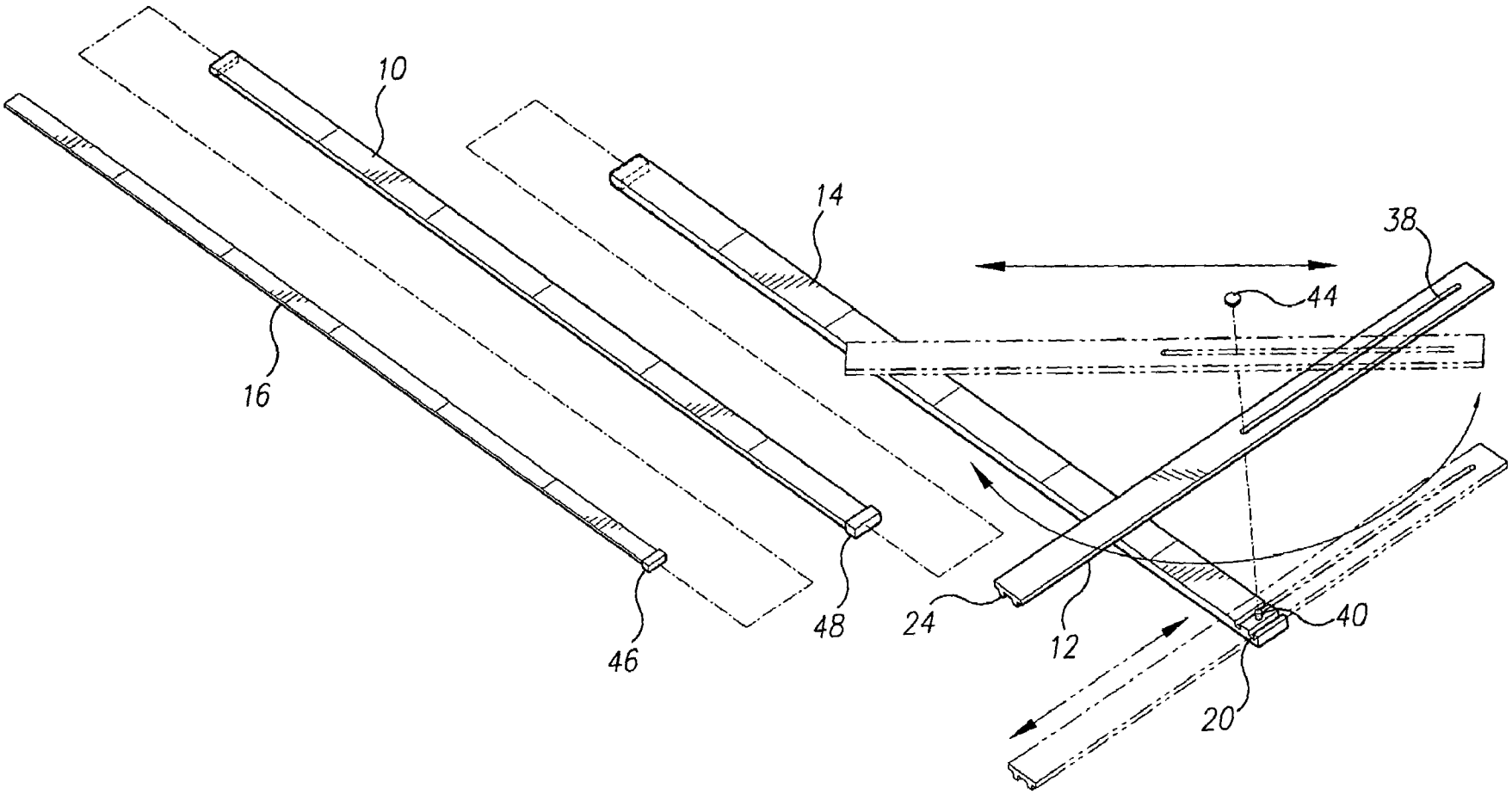
FIG. 2 is an exploded top perspective view of the telescoping T-square according to the present invention.

Referring to FIG. 2, a top exploded perspective view of the telescoping T-square is shown. The individual separated sections include the cross-member 12, the first or top section comprising the hollow rod 14, the second or middle section comprising the hollow rod 10, and the third or bottom section 16. These sections are combinable as indicated in FIG. 2. The long open slot 38 in the cross-member 12 fits over threaded bolt or stud 40, which is between the parallel slots or channels 20 in the first rod 14. The runners 24 in the cross-member 12 are positioned to slide within the channels 20. Knob 44 has an internally threaded shaft that engages bolt 40 to lock the T-square at exactly 90° when the runners 24 and channels 20 are aligned. Slot 38 extends from the center of cross-member 12 and extends laterally towards one end of the cross-member, and enables the telescoping leg to be offset from a position bisecting cross-member 12 while preserving a 90° angle between the cross-member and the leg by sliding the runners 24 in the slots 20. Telescopic section rods 10 and 16 may have plastic fittings 46 and 48 on their ends that, when inserted into the receiving rod, serve as spacers within the rods to keep the individual rods centered within the hollow and prevent any misalignment of the rods as assembled.

Figure 3:
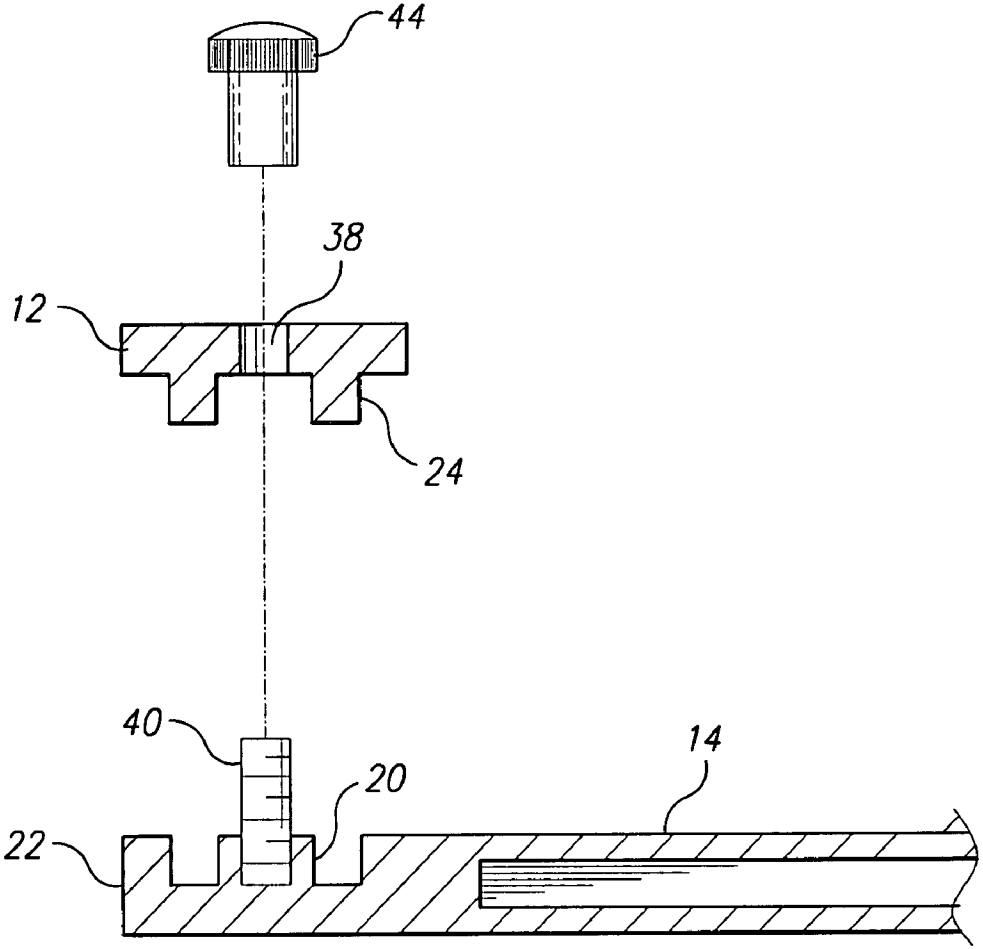
FIG. 3 is an exploded partial side view of an interlocking part of the telescoping T-square according to the present invention.

Referring to FIG. 3, the exploded partial side view shows the junction between cross-member 12 and first rod section 14. The runners 24 are dimensioned and configured to slide within channels 22. Once interlocked, the threaded section of the bolt or stud 40 passes through the open slot 38 in the cross-member and the internally threaded knob 44 is screwed onto the threaded bolt to lock the assembly in place and establish the angular disposition of the cross-member 12 and rod 14. When it is desired to place the telescoping leg at an acute angle relative to the cross-member 12, the runners 24 may be lifted out of the channels 20 and the cross-member 12 may be adjusted to the desired acute angle, the stud 40 still extending through slot 38, followed by tightening knob 44 on stud 48.

The top and/or bottom surfaces of the rods 14, 10 and 16 may have a scale imprinted or etched thereon. It will be understood that the number and spacing of the apertures 34 in the bottom surface of the rods 14, 10, and 16 may be adjusted to any desired interval to fix the length of the telescoping leg at any range of discrete lengths desired.

It is to be understood that the present invention is not limited to the embodiment described above, but encompasses any and all embodiments within the scope of the following claims.

I claim:

1. A telescoping T-square, comprising:

a flat, elongated cross-member having two parallel runners extending from a surface of the cross-member along the substantially the entire length of the cross-member, wherein: said cross-member has a slot defined therein extending from the center of the cross-member laterally towards one of the ends of the cross-member, the slot being parallel to and disposed between the runners;

a first rod member having a solid top end having two transverse parallel channels defined therein and an elongated hollow body extending from the top end, the channels being perpendicular to the elongated hollow body, the runners being slidable in the channels, said first rod member further includes a threaded stud extending from the top end, the stud being disposed between the channels, the stud being slidable within the slot defined in said cross-member;

a second elongated rod member telescopically slidable within the first rod member; and means for releasably connecting the cross-member and the first rod member, whereby the cross-member and the first and second rods form a T-square with a telescoping leg, said means for releasably connecting said cross-member and said first rod member including a knob threadably engaging the stud in order releasable secure said cross-member and said first rod together.

2. The telescoping T-square of claim 1, wherein said stud has a diameter less than a width of the slot.

3. The telescoping T-square of claim 1, wherein the open slot extends to about one-half of the length of the cross member.

4. The telescoping T-square of claim 1, wherein said stud has a length greater than a thickness of said cross-member, whereby said cross-member may be laid across said first rod member at an acute angle, said stud extending through the slot in said cross-member and said knob engaging said stud in order to releasably lock the first rod to the cross-member at the acute angle.

5. The telescoping T-square of claim 1, wherein said first and second rod members comprise rectangular aluminum rods.

6. The telescoping T-square of claim 1, further comprising a plastic sleeve disposed in a bottom end of said first rod member.

7. The telescoping T-square of claim 6, further comprising aplastic fitting disposed on an end of said second rod member telescopically disposed within said first rod member, said plastic sleeve and said plastic fitting maintaining said first and second rod members in proper alignment.

8. The telescoping T-square of claim 1, wherein said first rod member has a plurality of apertures defined therein at spaced intervals along the length of the elongated hollow body and said second rod member further comprises a spring-biased detent button at an end thereof, the button releasably engaging said apertures for adjusting the length of the telescoping leg in increments corresponding to the spaced intervals.

9. The telescoping T-square of claim 1, wherein said second rod member is hollow, the T-square further including a third telescopic rod member telescopically disposed and extendable from said second rod member.

10. The telescoping T-square of claim 9, wherein said telescoping leg extends to a length of about sixteen feet when said second and third rod members are fully extended.

11. A telescoping T-square, comprising:

at least a four foot long cross-member having two one-half inch wide separate parallel runners along the length of a bottom side, said cross member having a two foot long open slot with a width of at least three-eighths of an inch;

a first six foot long rectangular telescopic hollow rod member having two parallel channels along the width of a top end of the rod, wherein the dimensions of said runners and channels are reciprocal, said first rod having a plastic sleeve in the bottom end and six operable detent system apertures one foot apart along the bottom side surface of the rod;

a threaded stud centered between the two parallel channels and the width of the first telescopic rod;

an internally threaded knob screwed onto said stud, whereby said runners are releasably pressed into said channels to connect the cross member and the telescopic rod in a right angle;

a second six foot long telescopic hollow rod member having an internal plastic sleeve at one end, an external plastic sleeve at the opposite end to insert into the first rod and six operable spring loaded detent system apertures along the bottom side surface of the rod; and a third six foot long telescopic hollow rod member having an internal and/or external plastic sleeve at one end to connect to the second rod and an operable spring loaded detent system aperture along the bottom side surface of the third rod next to the plastic sleeve.

12. The T-square of claim 11, having a length of sixteen feet when fully extended.

* * * * *